US006022232A

United States Patent [19]

Pan et al.

[11] Patent Number: 6,022,232

[45] Date of Patent: Feb. 8, 2000

[54] ZIF CARD EDGE CONNECTOR

[75] Inventors: Hua-Tseng Pan, Taipei; Ching-Chang Meng, Tu-Chen; Chu-Mei Chen, Taipei, all of Taiwan

[73] Assignee: Hon Hai Precision Ind. Co., Ltd., Taipei Hsien, Taiwan

[21] Appl. No.: 09/016,856

[22] Filed: Jan. 30, 1998

[30] Foreign Application Priority Data

Jan. 30, 1997 [TW] Taiwan ..... 86201968

[51] Int. Cl.[7] ..... H01R 13/15

[52] U.S. Cl. ..... 439/260

[58] Field of Search ..... 439/59, 60, 260, 439/266, 267, 629–635, 701

[56] References Cited

U.S. PATENT DOCUMENTS 4,047,782 9/1977 Yeager ..... 439/267
4,636,021 1/1987 Bobb et al. ..... 439/260
4,648,668 3/1987 Sinisi ..... 439/260 X
4,743,203 5/1988 Grabbe ..... 439/260

*Primary Examiner*—Khiem Nguyen

[57] ABSTRACT

A card edge connector for receiving and retaining a card edge of a complementary card includes an upper housing and a lower housing each of which defines a central slot therein and the two central slots are in alignment with each other for receiving the card edge of the complementary card. A plurality of contacts each of which includes an upper portion and a lower portion are received in the upper and lower housings so that the upper portion of each contact is slidably received in the upper housing and the lower portion of each contact is fixed in the lower housing. A lever mechanism is pivotally engaged with the lower housing and firmly engaged with the upper housing so that when the lever mechanism is operated to raise the upper housing apart from the lower housing a predetermined distance, the card edge of the complementary card can be inserted into the aligned slots of the two housings with a substantially zero insertion force, and when the lever mechanism is operated to lower the upper housing to contact the lower housing, the upper portions of the contacts will abut against the card edge of the complementary card.

18 Claims, 4 Drawing Sheets

ZIF CARD EDGE CONNECTOR

BACKGROUND OF THE INVENTION

1. Field of the Invention

The present invention relates to a card edge connector, and particularly to a card edge connector having a configuration which allows for the movement of at least one row of contacts thereof for enlarging a reception space for a card edge of a complementary expansion card thereby enabling almost zero insertion force (ZIF) upon insertion of the complementary expansion card.

2. The Prior Art

A card edge connector interconnects at least one expansion card and a motherboard of a personal computer for transmitting electrical signals therebetween. The card edge connector and the complementary expansion card each contain a relatively large amount of contacts for electrical engagement with each other. However, a relatively strong insertion resistance exists due to the large number of contacts thus requiring an assembler to apply a substantial force during insertion and withdrawal of the expansion card. To facilitate the installation and removal of an expansion card, card edge connectors are equipped with a zero insertion force feature such as those disclosed in U.S. Pat. Nos. 4,047,782; 4,629,270; 4,480,884; 4,705,338; 4,863,395; 4,648,668; 4,498,722; 4,133,592; and 3,982,807.

All of these card edge connectors utilize a driving means to perform a horizontal or vertical drain function in order to loosen/tighten the engagement between the contacts of the card edge connector and the related complementary card. However, some disadvantages exist in the connectors disclosed in the above patents. For example, some of the card edge connectors are provided with too many components which makes them too cumbersome to be easily assembled such as those disclosed in U.S. Pat. Nos. 4,648,668 and 4,629,270. Another disadvantage is that the loosened and tightened status control between confronting contacts includes too many driving members linked together thereby complicating the manufacturing process thereof such as the disclosure of U.S. Pat. No. 4,047,782. A further disadvantage is that the required insertion force of some of the connectors is still too large such as those disclosed in U.S. Pat. Nos. 4,480,884 and 4,648,668.

SUMMARY OF THE INVENTION

The primary purpose of the present invention is to provide an improved card edge connector having a relatively simple structure which allows insertion of a complementary expansion card with an almost zero force.

In accordance with one aspect of the present invention, a card edge connector for receiving and retaining a card edge of a complementary card comprises an upper housing defining an upper central slot therein for receiving the card edge of the complementary card, and adjustment means exposed to the upper central slot for slidably receiving upper portions of the contacts therein and adjusting proximity of the upper portions of contacts to the card edge of the complementary card. A lower housing is suitably sized to mate with the upper housing and defines a second central slot aligned with the first central slot of the upper housing for retaining lower portions of the contacts therein. A lever mechanism includes pivot means attached to at least a side wall of the lower housing, engaging means secured to at least a side wall of the upper housing, and handle means manually operative to vertically move the upper housing relative to the lower housing. The card edge connector allows the complementary card to be inserted thereinto whereby that when the lever mechanism is operated to raise the upper housing to be spaced from the lower housing a predetermined distance, the adjustment means cooperates with the contacts resulting in a reception status of the first slot thus allowing the card edge of the complementary card to be inserted into the aligned first and second central slots with a substantially zero insertion force. When the lever mechanism is operated to lower the upper housing to contact the lower housing, the adjustment means forces the upper portions of the contacts to abut against the card edge of the complementary card.

DETAILED DESCRIPTION OF THE PREFERRED EMBODIMENTS

Figure 1:
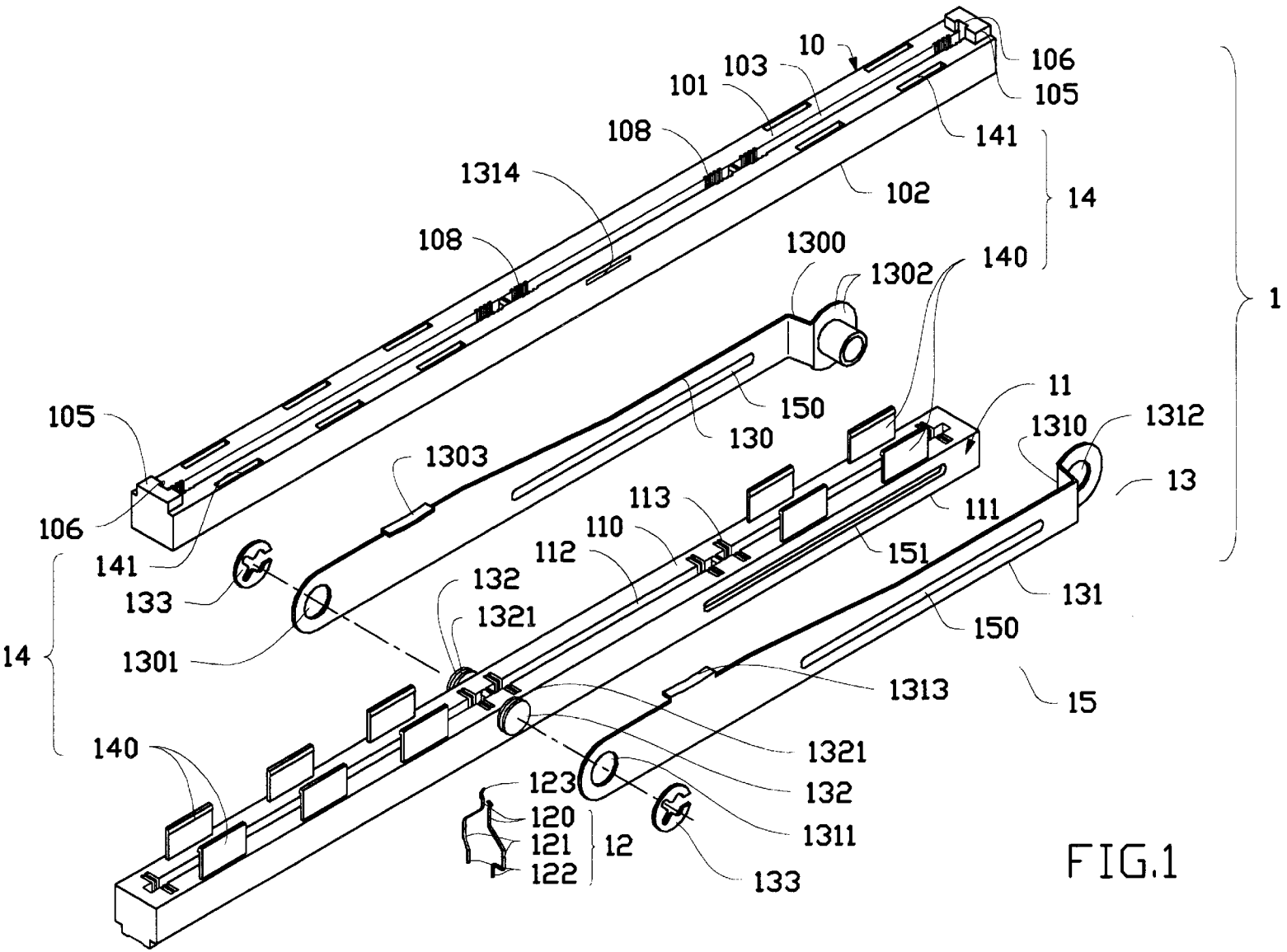
FIG. 1 is an exploded view of a card edge connector in accordance with the present invention.

Referring to the drawings and initially to FIG. 1, a card edge connector 1 for use with an expansion card (not shown) comprises a first insulative housing 10, a second insulative housing 11, two opposite rows of contacts 12 (only one pair shown) received in the second insulative housing 11, a lever mechanism 13, alignment means 14, and positioning means 15.

The first insulative housing 10 is elongately formed having a reception surface 101 on a top thereof and an engaging surface 102 on a bottom thereof, and a slot 103 is defined therein communicating with the reception surface 101 and the engaging surface 102 for receiving gold fingers of the expansion card. Two protrusions 105 respectively project from two distal ends of the reception surface 101 of the first insulative housing 10 and each defines a groove 106 exposed to the central slot 103 for guiding the insertion of the expansion card.

The second insulative housing 11 is also elongately formed and includes an engaging surface 110 on a top thereof and a soldering surface 111 on a bottom thereof for soldering to a printed circuit board (not shown). A central slot 112 is longitudinally defined in the engaging surface 110 of the second insulative housing 11 and aligns with the central slot 103 of the first insulative housing 10 which is stacked thereon. The expansion card is inserted and retained in the central slots 103, 112. A plurality of grooves 108 are defined in opposite side walls which define the slot 103 of the first insulative housing 10 from the reception surface 101 to the engaging surface 102. A number of grooves 113 are defined in opposite side walls which define the central slot 112 of the second insulative housing 11 and correspond to the grooves 108 of the first insulative housing 10. Each pair of grooves 108, 113 receives a contact 12.

Each contact 12 includes a contacting portion 120, an engaging portion 121, and a soldering portion 122. Two pivot members 132 respectively project from two opposite sides of the second insulative housing 11 and each pivot member 132 has a dumbell-like structure with a narrowed intermediate portion 1321.

The lever mechanism 13 comprises a first lever member 130 and a second lever member 131 having substantially the same length. The first lever member 130 defines a hole 1301 at one end thereof and forms an L-shaped engaging portion 1300 at another end from which a boss 1302 projects. The second lever member 131 also defines a hole 1311 at one end thereof and forms an L-shaped portion 1310 at another end in which a hole 1312 is defined.

The alignment means 14 comprises a row of spaced slots 141 defined in the first insulative housing 10 from the reception surface 101 to the engaging surface 102 on each side of the central slot 103 and a row of corresponding spaced plates projecting from the engaging surface 110 of the second insulative housing 11 on each side of the central slot 112. Each spaced plate 140 is slidably retained in a corresponding spaced slot 141 when the first insulative housing 10 is stacked on the second insulative housing 11.

Figure 2:
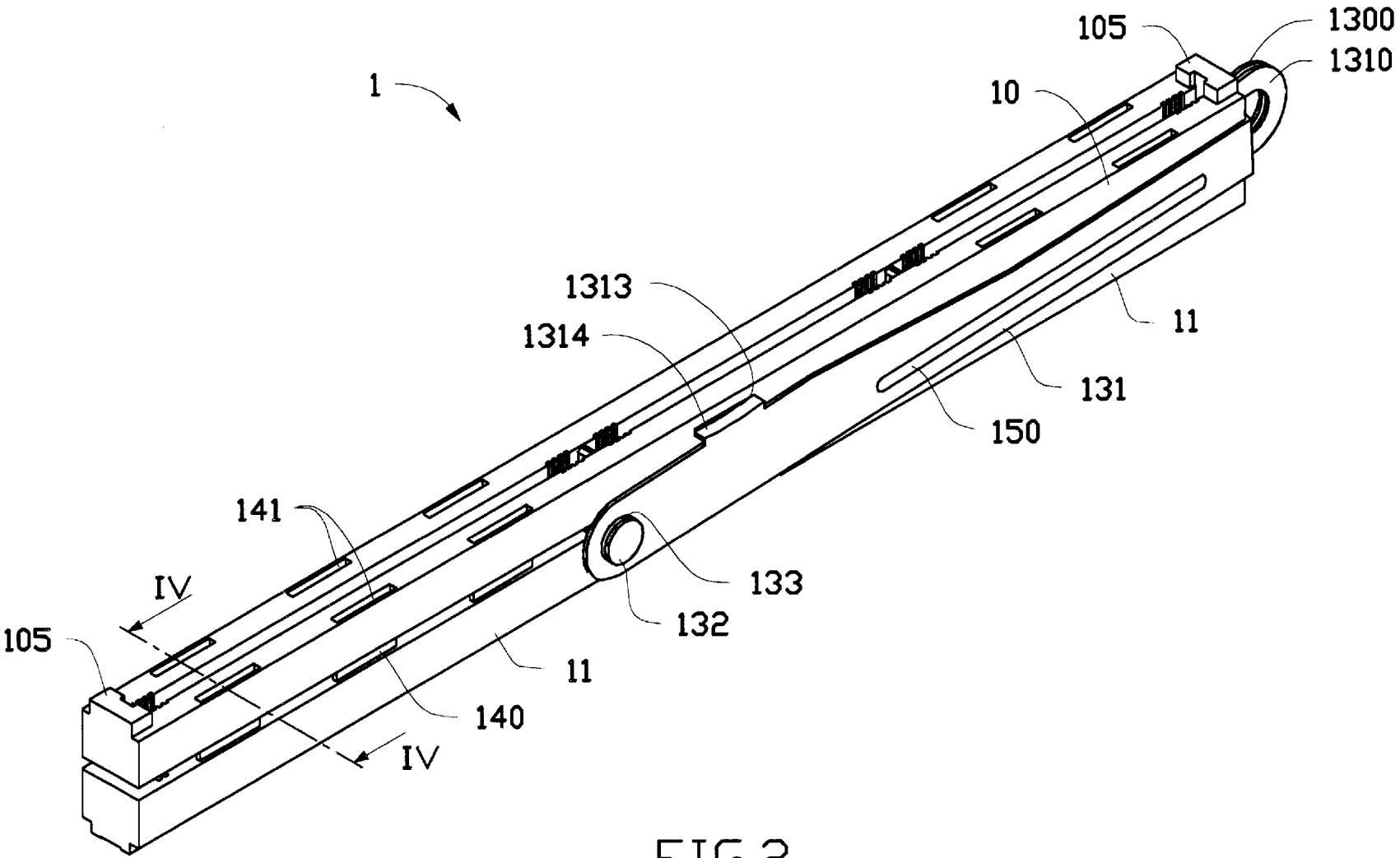
FIG. 2 is an assembled view of the card edge connector, where a first housing thereof has not yet firmly engaged with a second housing thereof.

Also referring to FIG. 2, in assembly, the first and second lever members 130, 131 are pivotally connected to elongate opposite sides of the second insulative housing 11 by respectively engaging the holes 1301, 1311 with the opposite pivot members 132. Specifically, the peripheries which define the holes 1301, 1311 pivot about the intermediate portion 1321. A washer 133 is received in the narrowed intermediate portion 1321 of the pivot member 132 for increasing frictional resistance between the periphery of the hole 1301 and the pivot member 132 in order to maintain the position of the lever members 130, 131 with respect to the pivot members 132 especially when the two lever members 130, 131 are raised from the other end 1300, 1310 thereof to facilitate reception of the card edge of the complementary expansion card.

The first and second pivot members 130, 131 are connected to each other at the engaging portion end 1300, 1310 by riveting the boss 1302 of the first pivot member 130 into the hole 1312 of the second insulative housing 131. The riveting engagement between the two engaging portions 1300, 1310 functions as a control end which will be explained later.

Figure 3:
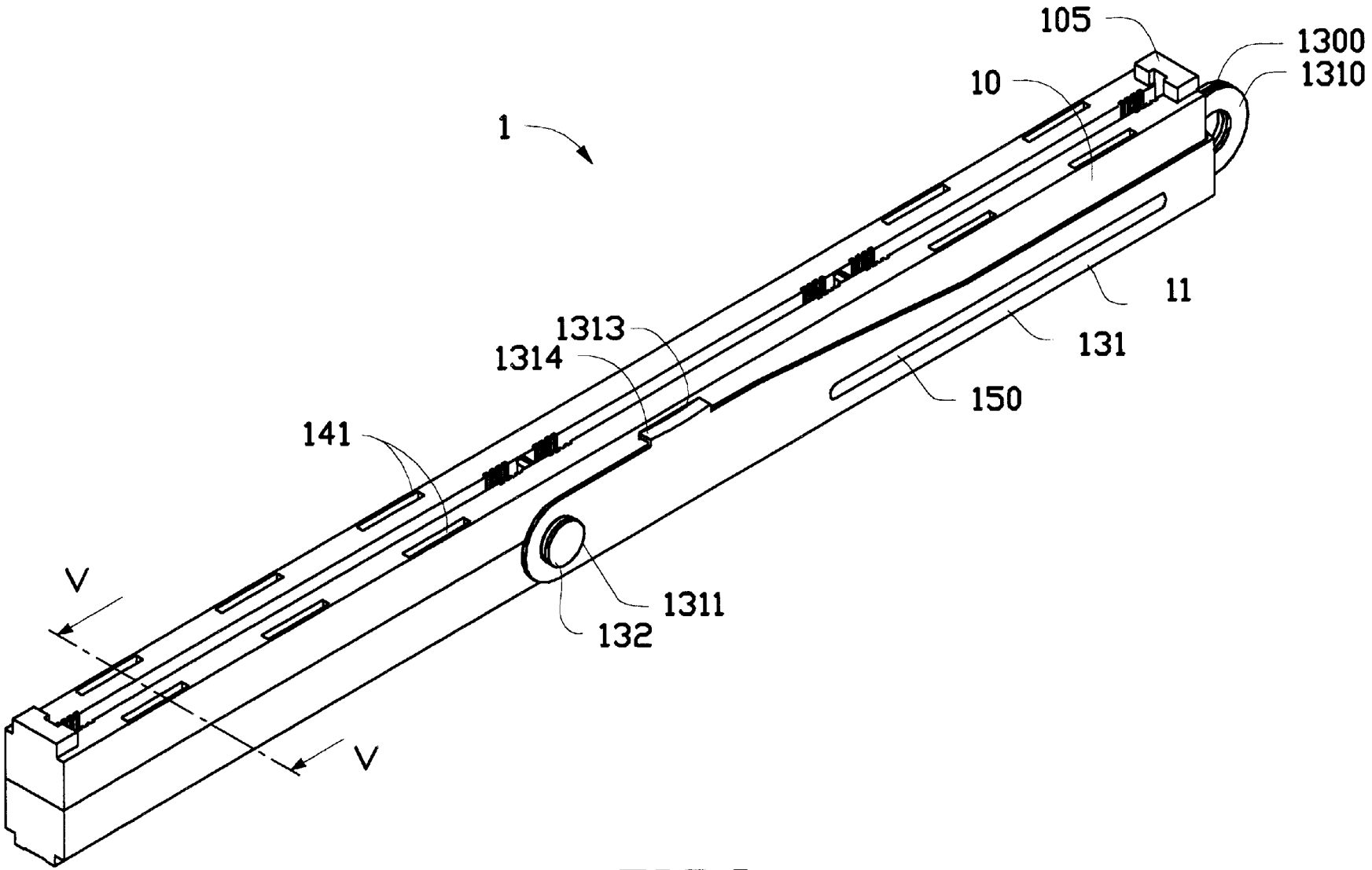
FIG. 3 is an assembled view of the card edge connector, wherein the first housing is firmly engaged with the second housing.

Tabs 1303, 1313 extend substantially perpendicular from intermediate portions of longitudinal edges of the first and second lever members 130, 131 respectively. Two slots 1314 (only one is shown in this figure) are defined in opposite side faces of the first insulative housing 10 for receiving and retaining the two tabs 1303, 1313. With this structure, the relationship between the first insulative housing 10 and the second insulative housing 11 can be manually controlled from a separate state to an engaged state as shown in FIGS. 2 and 3, respectively.

Specifically, the first insulative housing 10 can be raised or lowered via manual operation of the riveting engagement end of the lever members 130, 131. The plates 140 slide within the slots 141 when the first insulative housing 10 is moved with respect to the second insulative housing 11. The plates 140 together with the slots 141 constitute the alignment means 14 so that the corresponding pair of grooves 108, 113 always register with each other.

Two elongate grooves 151 are respectively defined in two opposite side surfaces of the second insulative housing 11. The first and second lever members 130, 131 each have a rib 150 formed on a surface thereof facing and mating with the grooves 151 of the second insulative housing 11. When the first and second insulative housings 10, 11 are spaced from each other, the ribs 150 are displaced from the grooves 151. When the first and second insulative housings 10, 11 contact with each other, the ribs 150 are fully received within the grooves 151. The engagement between the ribs 150 and the grooves 151 is a soft engagement, i.e., the first insulative housing 10 may be easily separated from the second insulative housing 11 by raising the engaging portions 1300, 1310 of the two lever members 130, 131.

FIG. 2 illustrates the separated state of the two insulative housings 10, 11, wherein the two lever members 131, 130 are raised to remain in an oblique status with respect to the soldering surface 111 of the second insulative housing 11. FIG. 3 illustrates the engagement state of the two insulative housings 10, 11, wherein the two lever members 131, 130 are lowered to remain in a horizontal status with respect to the soldering surface 111 of the second insulative housing 11.

Figure 4:
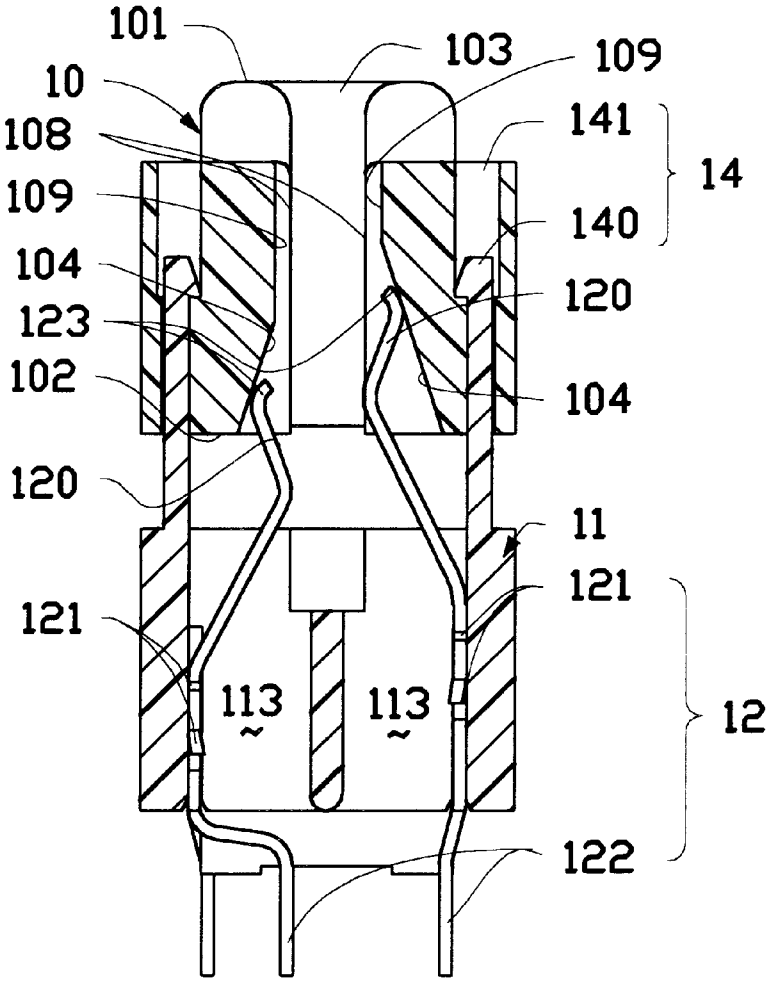
FIG. 4 is a cross-sectional view taken along line IV—IV of FIG. 2.
Figure 5:
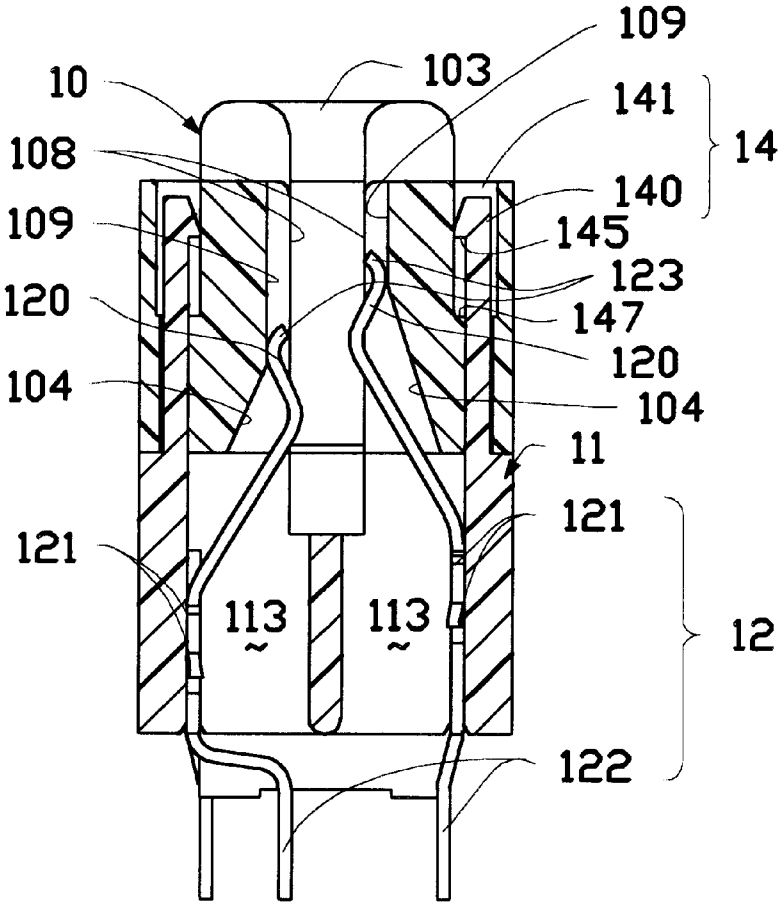
FIG. 5 is a cross-sectional view taken along line V—V of FIG. 3.

The position of the contacts 12 in relation to the inner portion of the two housings 10, 11 is illustrated in FIGS. 4 and 5 for the separated and engaged states of the card edge connector 1, respectively. The grooves 108 of the first insulative housing 10 are defined by two side walls (not shown) and a rear wall (not labeled) which includes a vertical wall portion 109 and a tapered wall portion 104 which widens each groove 108 towards the engaging surface 102 of the first insulative housing 10. Each pair of contacts 12 is retained in a corresponding opposite pair of grooves 113 of the second insulative housing 11 via the engaging portions 121 of the contacts 12 which are embedded between inner walls of the grooves 113. Since the engagement relationship between the contact 12 and the inner wall of the groove 113 is well known, it is not described in more detail. The soldering portions 122 of the contacts 12 are soldered on an external printed circuit board (not shown) by a well known soldering process, thus the connector 1 is fixed to the printed circuit board. The contacting portions 120 of the contacts 12 extend upward from the second insulative housing 11 and are received in the grooves 108 of the first insulative housing 10. The contacting portion 120 of each contact 12 is curved, with a free end 123 thereof abutting against the tapered inner surface 104 of the groove 108 when the two insulative housings 10 and 11 remain in a spaced relation. When the two insulative housings 10, 11 are spaced apart with this arrangement, the expansion card (not shown) can be easily inserted into the connector 1 substantially achieving ZIF effect because the width of the expansion card is less than the distance between the two opposite contacts 12. The free end 123 of the contact 12 is curved for facilitating movement of the first insulative housing 10 with respect to the second insulative housing 11. The free end 123 of the contact 12 slides along the tapered wall portion 104 of the groove 108 to abut against the vertical wall portion 109 thereof when the first insulative housing 10 contacts the second insulative housing 11. When the two insulative housings 10, 11 are in the engaged state, the distance between opposite contacts 12 is substantially equal to the width of the expansion card, i.e., as the lever mechanism 13 is lowered, the tapered wall portions 104 and the vertical wall portions 109 of the first insulative housing 10 continuously force the contacts 12 to abut against the inserted portion (gold finger) of the expansion card. In the engaged state, the final position of the free end 123 of each contact 12 does not need to abut against the vertical wall portion 109 rather the free end 123 may abut against the tapered wall portion 104 depending on the relative size of the vertical wall portion 109 and the tapered wall portion 104.

Each slot 141 of the alignment means 14 is formed with two shoulders 147 for narrowing a lower portion thereof and each plate 140 of the alignment means 14 is formed with a tapering flange 145 at a free end thereof for abutting against the shoulders 147 of the corresponding slot 141 thereby preventing the first insulative housing 10 from being raised beyond a predetermined pitch so that the plates 140 of the second insulative housing 11 can be maintained within the slots 141 of the first insulative housing 10.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A card edge connector for receiving and retaining a card edge of a complementary card comprising:

an upper housing defining an first central slot therein for receiving the card edge of the complementary card and adjustment means exposed to the first central slot for slidably receiving upper portions of contacts therein and adjusting proximity of the upper portions of contacts to the card edge of the complementary card;

a lower housing suitably sized to mate with the upper housing defining a second central slot in alignment with the first central slot of the upper housing and retaining lower portions of the contacts therein; and a lever mechanism including pivot means attached to at least a side wall of the lower housing, engaging means secured to at least one side wall of the upper housing, and handle means manually operative to move the upper housing relative to the lower housing;

whereby when the lever mechanism is operated to raise the upper housing to be spaced apart from the lower housing a predetermined distance, the adjustment means cooperates with the contacts to resulting in a reception status of the first slot thereby allowing the card edge of the complementary card to be inserted into the aligned first and second central slots requiring a substantially zero insertion force, and when the lever mechanism is operated to lower the upper housing to contact the lower housing, the adjustment means forces the upper portions of the contacts to abut against the card edge of the complementary card.

2. The card edge connector as claimed in claim 1, wherein the pivot means of the lever mechanism comprises at least a hole pivotally connected to a protrusion member projecting from the at least one side wall of the lower housing.

3. The card edge connector as claimed in claim 2, wherein the protrusion member is a dumbell-like structure and a periphery of the hole of the lever mechanism pivots about a narrowed intermediate portion of the dumbell-like structure when the lever mechanism is manually operated by the handle means thereof.

4. The card edge connector as claimed in claim 3 further comprising at least one washer received in the narrowed intermediate portion of the dumbell-like structure for increasing frictional resistance between the periphery of the hole and the dumbell-like structure thus retaining the upper housing in an elevated position with respect to the lower housing after the handle means of the lever mechanism is manually raised.

5. The card edge connector as claimed in claim 1, wherein the handle means comprises a lever arm structure linked to the engaging means and includes one operative end to move the engaging means of the lever mechanism.

6. The card edge connector as claimed in claim 5, wherein the lever arm structure comprises two arms connected by a bridging portion which has a protrusion for manual operation thereof.

7. The card edge connector as claimed in claim 6, wherein each of the lever arms comprises an L-shaped end connected together to constitute the bridging portion.

8. The card edge connector as claimed in claim 7, wherein a hole is defined in one of the two L-shaped ends and a rivet is formed on the other L-shaped end for riveting the two ends together.

9. The card edge connector as claimed in claim 8, wherein the engaging means of the lever mechanism comprises at least one tab extending from the lever mechanism for connecting to at least one corresponding side wall portion of the upper housing.

10. The card edge connector as claimed in claim 9, wherein the at least one corresponding side wall portion of the upper housing defines an opening for receiving and retaining the at least one tab.

11. The card edge connector as claimed in claim 1, wherein the adjustment means of the upper housing comprises a plurality of grooves each defined by two side walls and a central tapered wall which forces the contact to bend toward a central axis of the slot when the upper housing is lowered to contact the lower housing by operation of the lever mechanism.

12. The card edge connector as claimed in claim 1 further comprising guiding and aligning means for guiding the upper housing to contact the lower housing in a predetermined spatial relationship in which the first central slot of the upper housing is in alignment with the second central slot of the lower housing and the alignment is retained while the upper housing is moved with respect to the lower housing.

13. The card edge connector as claimed in claim 12, wherein the guiding and aligning means comprises a plurality of spaced protrusions formed on one of the upper housing and the lower housing, and a corresponding number of apertures defined in the other of the upper housing and the lower housing for slidably receiving the spaced protrusions.

14. The card edge connector as claimed in claim 13, wherein each of the spaced protrusions includes a flange end and each aperture of the guiding and aligning means is defined by an inner periphery which comprises at least a shoulder wall portion to stop the flange end of the protrusion in order to limit the upper housing from moving beyond a predetermined pitch with respect to the lower housing.

15. The card edge connector as claimed in claim 1 further comprising a positioning means for detachably retaining the upper housing in contact with the lower housing when the lever mechanism is operated to lower the upper housing to contact the lower housing.

16. The card edge connector as claimed in claim 15, wherein the positioning means comprises at least one protrusion formed on the lever mechanism and at least a corresponding recess defined in the lower housing for detachably retaining the at least one protrusion therein when the lever mechanism is operated to lower the upper housing to contact the lower housing.

17. A card edge connector for receiving and retaining a card edge of a complementary card comprising:

an elongated first member adapted to be vertically moveable relative to an elongated second member having a substantially same dimension along a lengthwise direction of both the first member and the second member, by means of a lever mechanism pivotally secured to one of the first member and the second member on one position and also properly engaged with the other of the first member and the second member on another position;

a plurality of contacts disposed within said first member and said second member; whereby said contacts can be displayed in a reception status by a first relative vertical movement between said first member and said second member due to a first rotation of the lever mechanism, thus allowing the complementary card to be inserted into at least one of said first member and second member requiring a substantially zero insertion force;

said contacts can be displayed in an engagement status by a second relative vertical movement, opposite to said first relative vertical movement, between the first member and the second member due to a second rotation, reverse to said first rotation, of the lever mechanism for abutment against the inserted complementary card.

18. The card edge connector as claimed in claim 17 further including means for maintaining the first member and the second member in position without any relative vertical movement therebetween when the contacts mechanically engage the inserted card.

* * * * *